United States Patent [19]

Stranczek

[11] 4,210,788

[45] Jul. 1, 1980

[54] MANUAL OPERATING HANDLE ASSEMBLY FOR CIRCUIT INTERRUPTER DEVICES

[75] Inventor: Norman J. Stranczek, Niles, Ill.

[73] Assignee: S&C Electric Company, Chicago, Ill.

[21] Appl. No.: 923,232

[22] Filed: Jul. 10, 1978

[51] Int. Cl.[2] ..... H01H 9/28

[52] U.S. Cl. ..... 200/42 T; 74/527; 200/44; 200/320; 200/334

[58] Field of Search ..... 200/48 R, 334, 335, 200/321, 50 R, 331, 44, 320, 42 T; 74/527, 532; 70/181–184, 203

[56] References Cited

U.S. PATENT DOCUMENTS

| | | | |
|---|---|---|---|
| 1,370,501 | 3/1921 | Knudsen | 200/334 |
| 2,547,153 | 4/1951 | Caswell | 200/320 |
| 2,950,363 | 8/1960 | Bachman et al. | 200/334 |
| 3,022,391 | 2/1962 | Oravec | 200/44 |
| 3,213,213 | 10/1965 | De Smidt | 200/334 |

*Primary Examiner*—Frederick R. Schmidt
*Attorney, Agent, or Firm*—John D. Kaufmann

[57] ABSTRACT

A manually operated handle assembly for operating high voltage circuit interrupter devices which are suitable for circuit opening operations but which are not suitable for circuit closing operations. Interrupter devices for which the handle assembly embodied in the present invention is suitable, therefore, are intended to be used in conjunction with a disconnect switch that is suitable for circuit-closing operations. By removing a lock bar, which unless removed prevents movement of the operating handle, and raising the operating handle to the horizontal position, the operating handle can be pivoted to rotate an operating shaft which causes the interrupter device to trip open. Closing the interrupter device is accomplished by pivoting the operating handle farther and thereby rotating the operating shaft an additional amount. The handle assembly provides an interlock feature which prevents the interrupter device being operated by the handle from being inadvertently closed unless the associated disconnect switch is open. However, the interlock feature does not interfere with operation of the handle assembly to cause the interrupter device to trip open. The interlock feature of the disclosed invention incorporates a key operated locking mechanism which prevents operation of the handle to complete the closing of the interrupter device unless an associated disconnect switch has been opened and locked in the open position. The operating handle is held in a horizontal position except when it is rotated to the "home" position, thereby providing a visual indication when the interrupter device is not in the "home" position.

15 Claims, 12 Drawing Figures

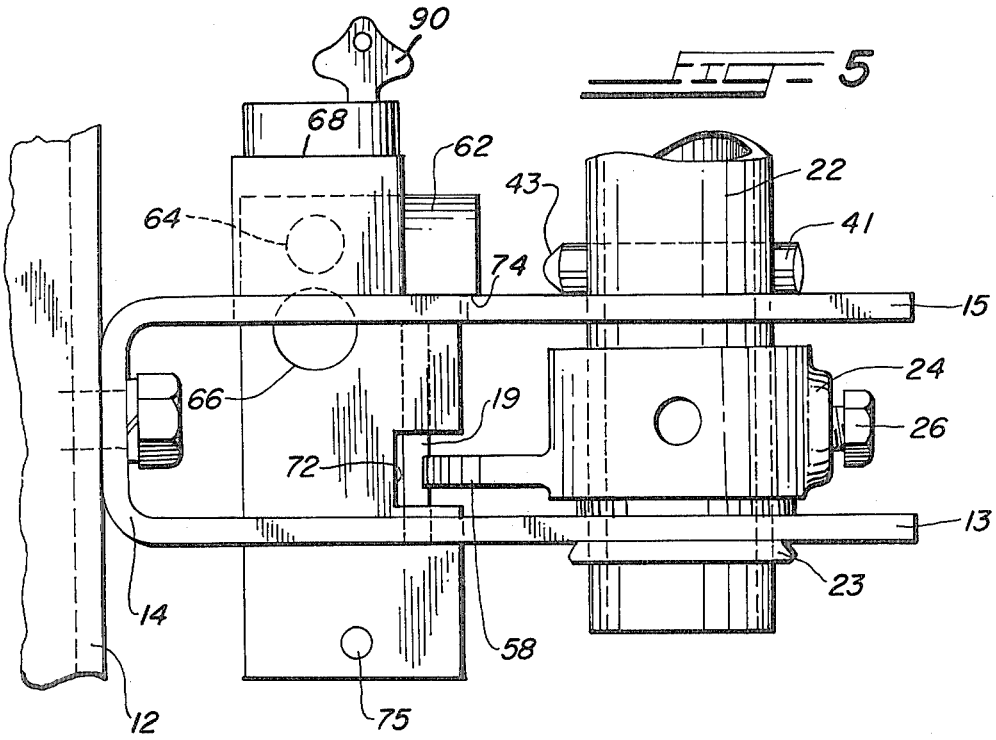
FIG. 5
FIG. 6
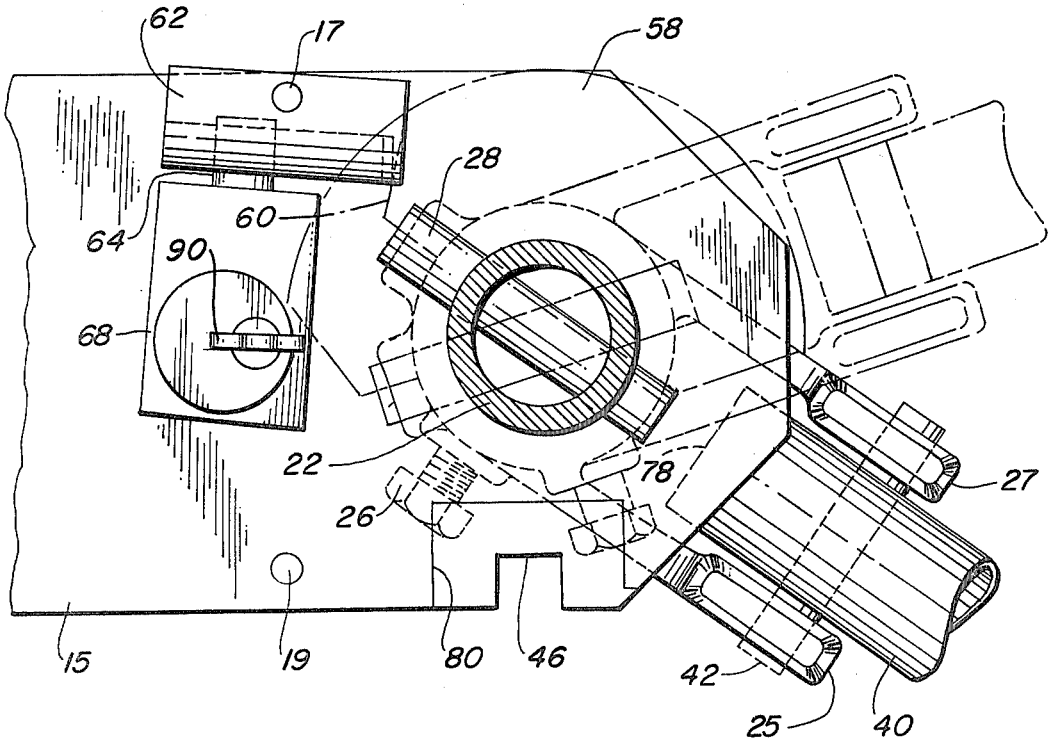

MANUAL OPERATING HANDLE ASSEMBLY FOR CIRCUIT INTERRUPTER DEVICES

BACKGROUND OF THE INVENTION

1. Field of the Invention

The present invention relates to a handle assembly for manually operating high voltage circuit interrupter devices, and more particularly, to a handle assembly that provides a first mechanical interlock to prevent any movement of the handle assembly and a second mechanical interlock which permits operation of the handle assembly to trip open the interrupter device, but which prevents operation of the handle assembly to close the interrupter device unless an associated disconnect switch is locked in the open position.

2. Description of the Prior Art

It is known in the art of manually operated switch handles to make them padlockable in one or the other extreme operating position, that is, in the switch open or switch closed position. Further, it is also known in the art to provide control or operating handles for switches with key interlock features. However, it is not known in the prior art to provide an operating handle which permits limited movement for a specific function and which also provides key-interlocked movement for a distinctly different function. In the prior art, two separate handles and driving mechanisms are required to perform the functions of tripping a switch open subject to a first locking feature and also of closing or resetting the switch subject to a second locking feature.

Prior art devices do not retain the operating handle in two unique positions so as to provide a visual indication when the handle and the interrupter device are not in their normal positions.

Prior art interlock mechanisms for use in connection with operating handles for high voltage interrupter devices do not provide a dead latch feature which prevents force from being applied to the locking mechanism by pivoting of the operating handle.

Thus, it would be a desirable advance in the art to combine the two functions of tripping open and resetting the controlled switch into a single control handle while providing separate interlock features for each of the two functions.

It would also be a desirable advance in the art to provide an operating handle that provides a visual indication when the operating handle and the interrupter device are not in their normal positions.

It would be another desirable advance in the art to provide an interlock mechansim for use in connection with operating handles for high voltage interrupter devices that provided a dead latch feature which would prevent the application of force to the locking mechanism by pivoting of the operating handle.

BRIEF DESCRIPTION OF THE INVENTION

A manual operating handle assembly for operating a high voltage circuit interrupter device in accordance with the present invention comprises an operating handle pivotably mounted to a handle bracket which is rigidly secured to an operating shaft. Pivoting the operating handle and thereby rotating the operating shaft in a first direction through a predetermined angular rotation causes the interrupter device to trip open. Pivoting the operating handle farther and thereby rotating the operating shaft in the first direction an additional amount causes the interrupter device to close again.

The present invention is intended for a high voltage circuit interrupter device which is suitable for circuit-opening operations but which is not suitable for circuit-closing operations. By opening an associated disconnect switch which is suitable for circuit-closing operations and which is connected in series with the high voltage circuit interrupter device, the high voltage circuit interrupter device can be closed without damaging the device while the circuit is de-energized. The present invention provides an interlock feature that prevents closing the interrupter device being operated by the manual operating handle assembly unless the associated disconnect switch is in the open position. The interlock feature uses a key operated locking mechanism to prevent rotation of the operating handle for a closing stroke except when the locking mechanism is operated by a key to retract an interlock bolt from engagement with an interlock bar. When the interlock bolt is extended and engaged with the interlock bar, the interlock bar is held in position to mechanically interfere with a flange member of the handle bracket. Mechanical interference between the flange member and the interlock bar, which occurs when the operating handle is pivoted far enough to trip open the interrupting device, prevents the operating handle from being pivoted farther to rotate the operating shaft for the closing stroke. A dead latch feature is provided so that force which may be applied to the interlock bar by a human operator pivoting the operating handle and thereby pushing the flange member against the interlock bar is not transmitted to the interlock bolt or the locking mechanism. By means of the key, which is only available when the associated disconnect switch is in the open position, the locking mechanism can be operated to retract the interlock bolt and to thereby disengage the interlock bar. The interlock bar is then free to drop down to a position in which a slot in the interlock bar is aligned with the flange member of the handle bracket. In this position, the interlock bar no longer presents mechanical interference with the flange member; therefore, the operating handle can be pivoted to rotate the operating shaft to close the interrupter device.

After the interrupter device has been closed, the operating handle can be rotated in a second direction to a "home" position in which it can be folded downward to its vertical "stowed" position. Except when rotated to the "home" position, the operating handle extends outward in a horizontal position and is prevented from being folded downward by mechanical interference between the end of the operating handle and upper and lower horizontal plate members of a mounting bracket. A slot in the upper horizontal plate member of the mounting bracket permits the operating handle to be folded downward when rotated to the "home" position. Thus, the horizontal configuration of the operating handle provides a visual indication that the operating handle is not in the "stowed" position. When folded downward to the "stowed" position, a tab on the operating handle extends into a slot in the lower horizontal plate member of the mounting bracket to prevent pivoting of the operating handle while in the "stowed" position. A lock bar which can be inserted through holes in the handle bracket and in the operating handle when the operating handle is in the "stowed" position, and which can be padlocked, prevents manual tripping of the interrupter device by means of the operating handle. By removing the lock bar, the operating handle can be unfolded and rotated far enough to trip the interrupter device open without using the key to operate the locking mechanism and retracting the interlock bolt.

A variation of the preferred embodiment of the present invention is provided for installations in which it is desirable to rotate the operating shaft by means of an operating handle that is separate from the manual operating handle assembly. Thus, when the operating shaft is being used to operate a three-pole interrupter device the torque required to rotate the operating shaft is too great to permit manual pivoting of the operating shaft by an operating handle directly. For such applications a variation of the present invention is provided in which the operating shaft extends below the manual operating handle assembly and is rotated by means of a gearbox mechanism. In this variation of the present invention the operating handle is reduced to a stub which provides a tab for preventing rotation when stub is in the "stowed" position and the lock bar is inserted. In all other respects the variation of the present invention is similar to the preferred embodiment described above.

In another variation of the preferred embodiment of the present invention, a mirror image of the preferred embodiment is provided for installations in which rotation of the operating shaft in a second direction is required to operate the high voltage circuit interrupter device. Thus, variations of the present invention permit operation of high voltage circuit interrupter devices regardless of whether clockwise or counterclockwise rotation of the operating shaft is required to trip open and then to close such devices.

Thus, it is a primary object of the present invention to provide an operating handle assembly for manual operation of a high voltage circuit interrupter device which can be locked in a position to prevent any manual operation of the interrupter device.

It is another object of the present invention to provide an operating handle assembly for manually triping open an interrupter device while being locked with respect to its other function of closing the interrupter device.

It is another object of the present invention to provide an operating handle assembly for manual operation which is interlocked with an associated disconnect switch so that the operating handle assembly cannot be operated to close the interrupter device unless the associated disconnect switch is locked in the open position.

It is another object of the present invention to provide an operating handle assembly for manual operation of an interrupter device which gives a visual indication when the operating handle assembly is not in its normal "stowed" position.

These and other objects, advantages, and features will hereinafter appear, and for purposes of illustration, but not for limitation, exemplary embodiments of the present invention are illustrated in the accompanying drawings.

DESCRIPTION OF THE DRAWINGS

FIG. 5 is a partially fragmentary side elevational view of the present invention with both the lock bar and the interlock bolt withdrawn and the operating handle raised to the horizontal position and pivoted to close the interrupter device, but otherwise taken from the same aspect as FIG. 4.

FIG. 6 is partially fragmentary top view showing the limit to which the operating handle of the present invention can be pivoted with the interlock bar in the locked position and showing in phantom the operating handle of the present invention rotated farther with the interlock bar in the unlocked position.

DETAILED DESCRIPTION OF THE PREFERRED EMBODIMENT

Figure 1:
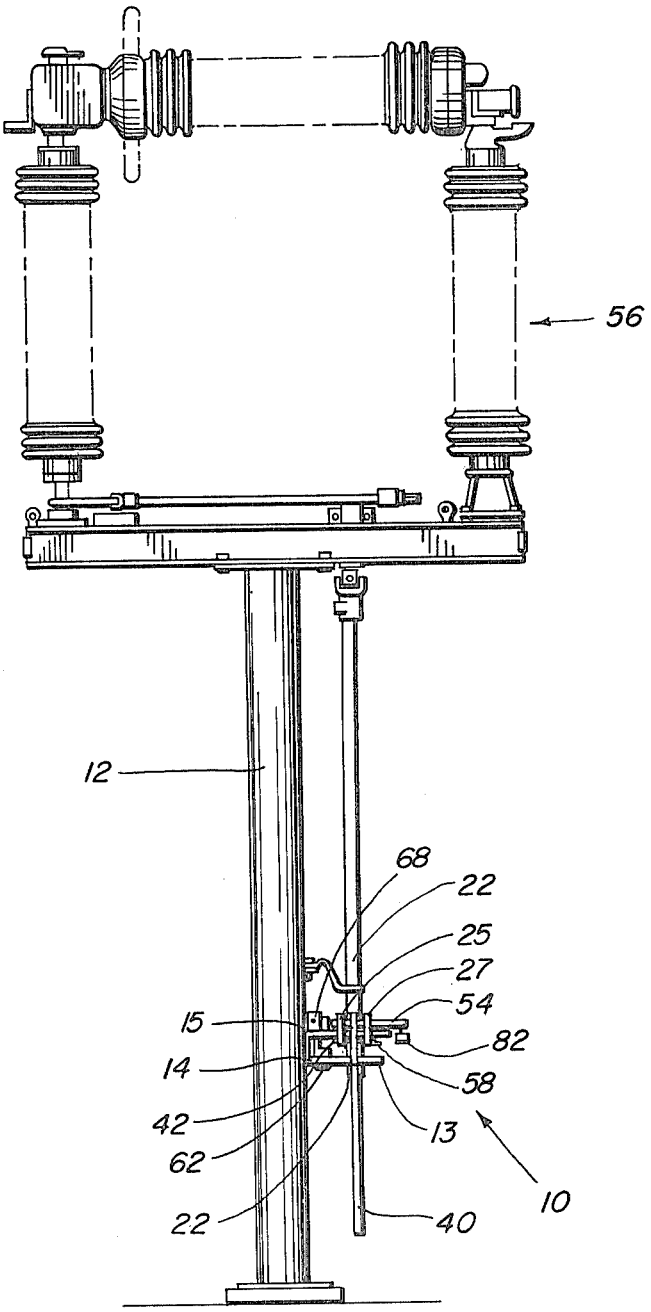
FIG. 1 is a side elevational view of the preferred embodiment of the present invention and an interrupter switch which is operated by the present invention.
Figure 2:
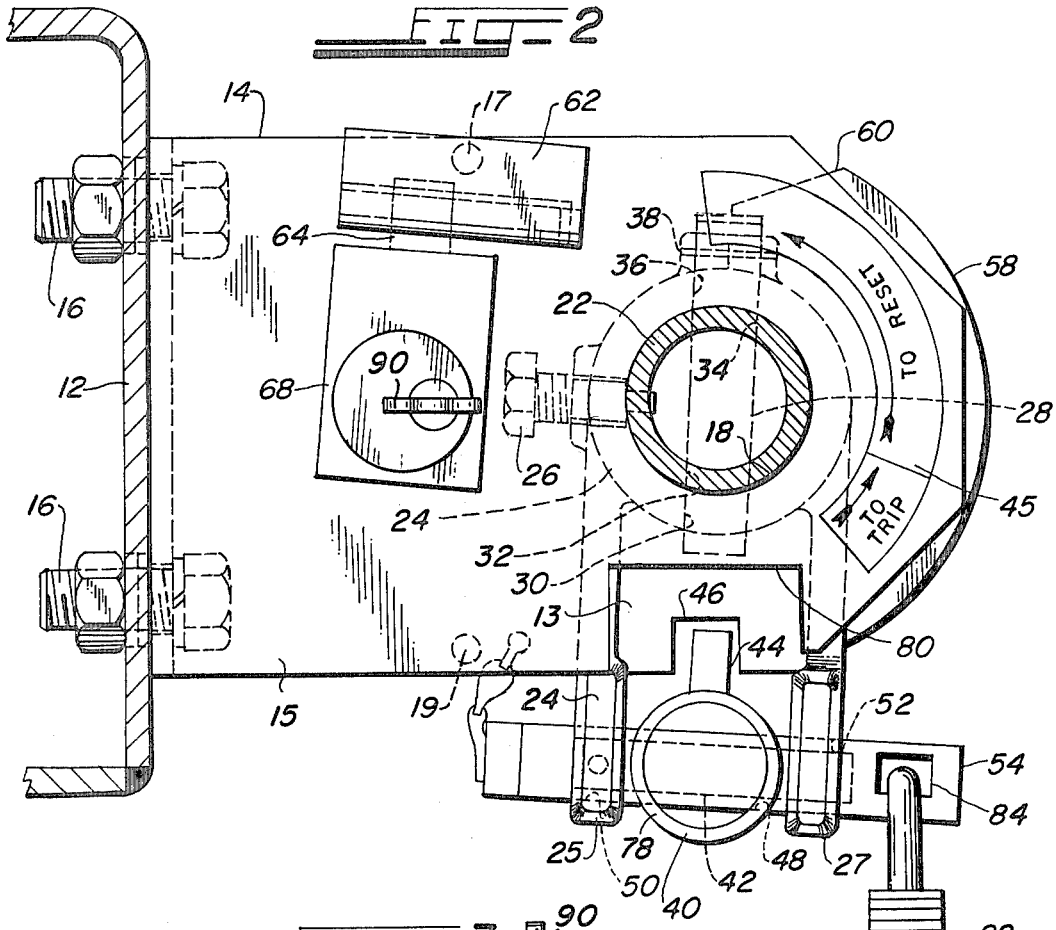
FIG. 2 is a cross sectional top view of the preferred embodiment of the present invention showing the operating handle in the folded position with both the lock bar and interlock bolt in locked positions.

With reference to FIGS. 1 and 2, mounting bracket 14 of manual operating handle assembly 10 is rigidly attached to a base comprised of support structure 12 by some suitable attachment means, such as mounting bolts 16. Mounting bracket 14 has upper plate 15 and lower plate 13. With reference to FIGS. 2, 4, 5 and 6, support rods 17 and 19 are suitably fastened to upper and lower plates 15 and 13, as by welding. Support rods 17 and 19 add structural support to upper and lower plates 15 and 13 of mounting bracket 14. Manual operating handle assembly 10 is operably connected to high voltage circuit interrupter device 56 by operating shaft 22. Counterclockwise rotation (as viewed from above) of operating shaft 22 through a predetermined angle causes interrupter device 56 to trip open, and further counterclockwise rotation of operating shaft 22 through a greater predetermined angle causes interrupter device 56 to close again.

Figure 3:
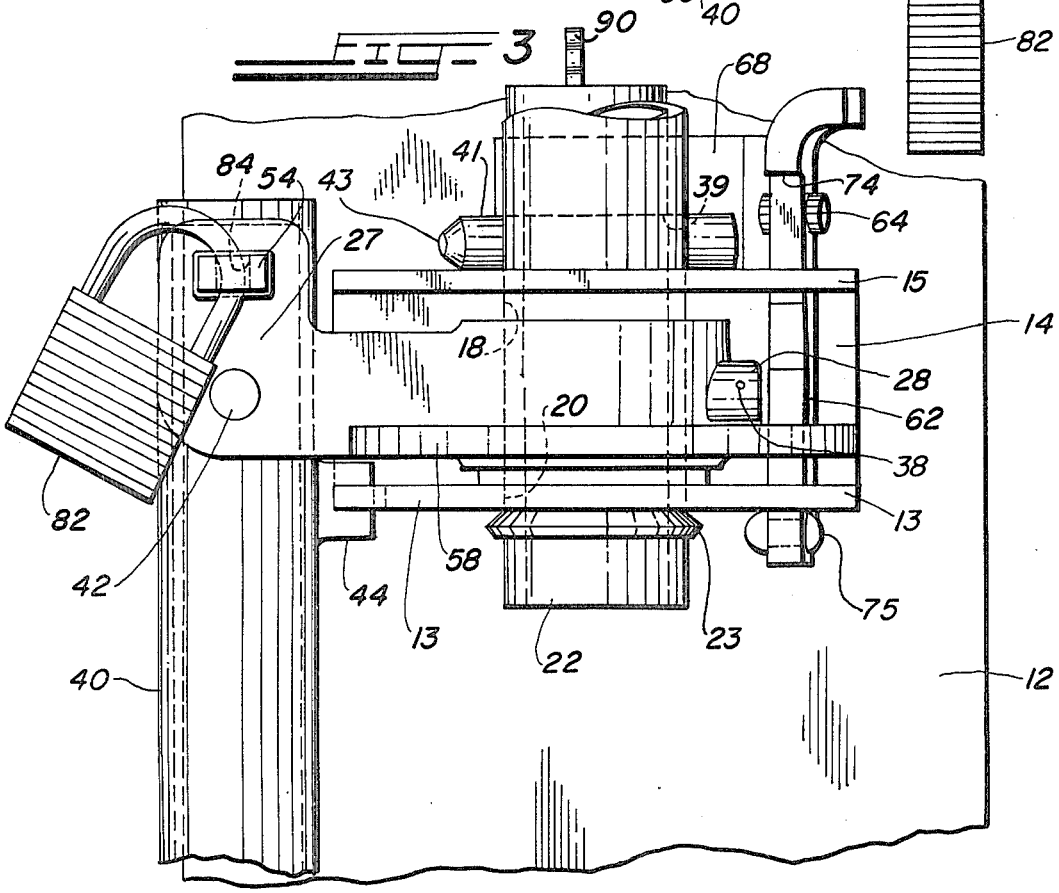
FIG. 3 is a partially fragmentary front elevational view showing the present invention in the same configuration as, and from the right of, FIG. 2.
Figure 4:
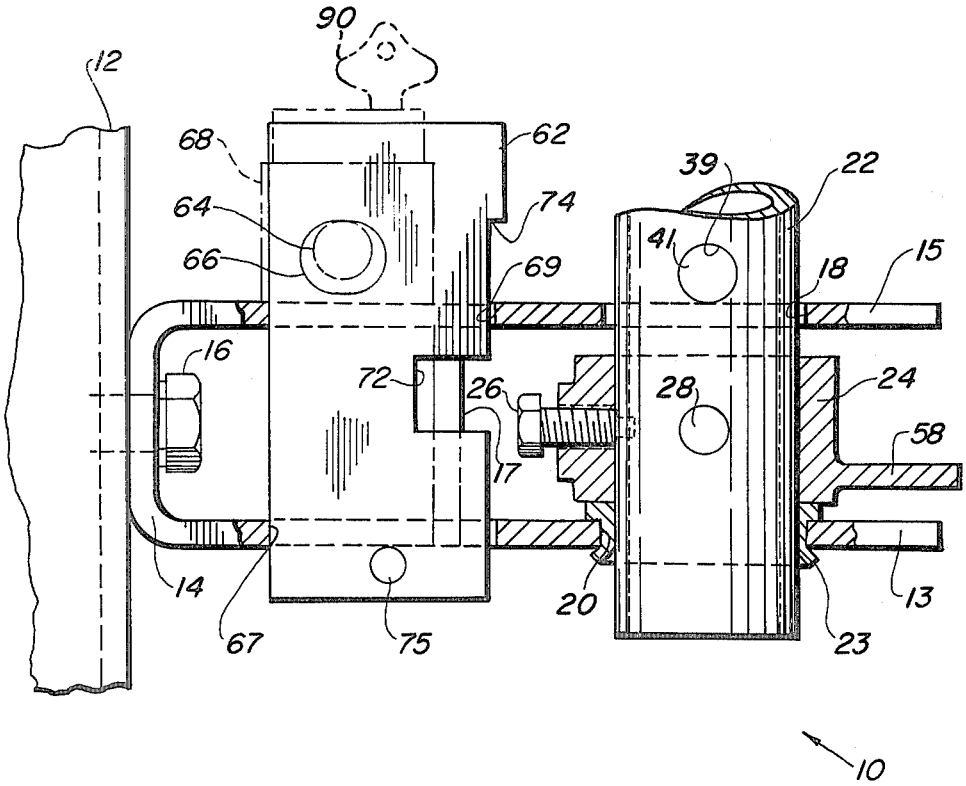
FIG. 4 is a partially fragmentary side elevational view showing the present invention in the same configuration as FIG. 2, taken from the right of FIG. 3.

As shown in FIGS. 2, 3 and 4, upper plate 15 of mounting bracket 14 contains hole 18 and lower plate 13 of mounting bracket 14 contains hole 20. Operating shaft 22, which can be a length of pipe, extends through hole 18 in upper plate 15 of mounting bracket 14 and is rotatably supported by guide bearing 23 which is rigidly mounted in hole 20 in lower plate 13 of mounting bracket 14. Handle bracket 24 rides on guide bearing 23 between upper and lower plates 15 and 13 of mounting bracket 14 and is rigidly secured to operating shaft 22 for the purpose of imparting rotation to it, as will be more fully described below. Handle bracket 24 is rigidly secured to operating shaft 22 by piercing-type setscrew 26, which is threaded through handle bracket 24 and which pierces or penetrates operating shaft 22. Vandal-proof pin 28 passes through holes 30 and 36 in handle support 24 and through holes 32 and 34 in operating shaft 22. Therefore, pin 28 also serves to secure handle support 24 to operating shaft 22. Pin 28 is secured in handle bracket 24 by pin 38, which is driven through handle bracket 24 and pin 28 as shown in FIG. 2. Pin 38 thus renders pin 28 virtually unremovable without the use of specialized tools in the field and serves to "vandal-proof" handle assembly 10. Retaining pin 41 is suitably secured in hole 39 in operating shaft 22 a short distance above upper plate 15 of mounting bracket 14. Retaining pin 41 thus tends to prevent camming-upward of upper plate 15 of mounting bracket 14 in the event a person maneuvering operatng handle 40 bears downward heavily on operating handle 40 when it is in an intermediate position, as shown in FIG. 6, thereby causing the end of operating handle 40 to bear upward against the lower surface of upper plate 15. Retaining pin 41 has pointed end 43 which serves as a pointer related to indicia on indicating label 45 which is suitably affixed to upper plate 15 as shown in FIG. 2. Retaining pin 41 and indicating label 45 provide an indication of when operating shaft 22 is rotated far enough to trip open interrupter device 56 and to close interrupter device 56 again.

With reference to FIGS. 1, 2, and 3, operating handle 40, which can be comprised of a length of pipe, is pivotably mounted to handle bracket 24 by pivot pin 42. Pivot pin 42 is suitably mounted in members 25 and 27 of handle bracket 24, and operating handle 40 pivots in a vertical plane on pivot pin 42 between first and second mounting members 25 and 27. Locking tab 44 projecting from operating handle 40 is arranged to fit in slot 46 in lower plate 13 of mounting bracket 14 when operating handle 40 is in the "stowed" or downward folded position. Operating handle 40 contains rectangular hole 48 which aligns with rectangular slots 50 and 52 in members 25 and 27 of handle bracket 24, thereby permitting lock bar 54 to be inserted through handle bracket 24 and operating handle 40 when operating handle 40 is in the "stowed" or downward folded position. The presence of lock bar 54 in holes 48, 50, and 52 prevents the unfolding of operating handle 40 to the horizontal position, and, therefore, due to the engagement of locking tab 44 with slot 46, relative rotation of handle bracket 24 and operating shaft 22 with respect to mounting bracket 14 is prevented. By removing lock bar 54, operating handle 40 can be unfolded and extended to the horizontal position, thereby disengaging locking tab 44 from slot 46 and permitting operating handle 40 to be rotated counterclockwise. Rotation of operating handle 40 is imparted to operating shaft 22 by handle bracket 24 so that operating handle 40 can be pivoted to trip circuit interrupter device 56 (shown in FIG. 1) to the open position and then to close interrupter device 56 again.

Except when operating handle 40 is rotated to the "home" position shown in FIGS. 1, 2 and 3, operating handle 40 cannot be folded downward to its "stowed" position. End 78 of operating handle 40 is restrained between upper and lower plates 15 and 13, respectively, of mounting bracket 14 (see FIG. 6) and therefore operating handle 40 is held in a horizontal position except when operating handle 40 is rotated to the "home" position shown in FIG. 2. When operating handle 40 is rotated to the "home" position, slot 80 in upper plate 15 of mounting bracket 14 clears end 78 and permits operating handle 40 to be folded downward to the "stowed" position. Therefore, since operating handle 40 is held extended horizontally except when rotated to the "home" position, whenever circuit interrupter device 56 is in a condition other than set or reset and ready to trip, such is visually indicated by the horizontal position of operating handle 40. Lock bar 54 may be inserted when operating handle 40 is pivoted to the "home" position and folded downward to its "stowed" position to prevent any rotation of operating shaft 22 by operating handle 40. As shown in FIGS. 2 and 3, padlock 82 can be inserted through hole 84 in lock bar 54 to lock operating handle 40 in the "stowed" position. When locked in this configuration, manual tripping of interrupter device 56 by pivoting operating handle 40 is prevented.

With reference to FIGS. 4 and 5 interlock bar 62, which is slidably mounted in rectangular holes 67 and 69 in lower and upper plates 13 and 15, respectively, has stop surface 74, retaining member 75, and hole 66.

Arcuate flange member 58 of handle bracket 24 has surface 60 (FIG. 2) which impinges on interlock bar 62 when interlock bar 62 is in the raised or locked position as shown in FIGS. 3 and 4 so as to limit the rotation of handle bracket 24 and, consequently, of operating shaft 22. In this position of the interlock bar 62, mechanical interference between interlock bar 62 and surface 60 of flange member 58 prevents rotation of operating shaft 22 to close interrupter device 56. Since interlock bar 62 is restrained by upper plate 15 and lower plate 13 of mounting bracket 14 except in the vertical direction, force which may be applied by flange member 58 being rotated against interlock bar 62 is applied to the plates 13 and 15 and is not transmitted to an interlock bolt 64 or a locking mechanism 68. This dead latch feature prevents damage to the locking mechanism by a human operator pivoting the surface 60 of flange member 58 against interlock bar 62 when interlock bar 62 is in the locked position. Locking mechanism 68 is a commonly available key actuated bolt mechanism having interlock bolt 64 which extends outward when locking mechanism 68 is in the locked position and which can be retracted by operating locking mechanism 68 with a key 90. The key 90 which operates locking mechanism 68 cannot be removed from locking mechanism 68 except when interlock bolt 64 is locked in the extended position. Locking mechanism 68 is rigidly mounted to the top surface of upper plate 15 of mounting bracket 14. When interlock bolt 64 from locking mechanism 68 is locked in the extended position it projects through hole 66 in interlock bar 62, thereby holding interlock bar 62 in the raised or locked position whereat it mechanically interferes with surface 60 of flange 58 when operating handle 40 is pivoted. Thus, the mechanical interference between surface 60 of flange 58 and interlock bar 62 limits rotation of handle support 24 and operating shaft 22. When interlock bolt 64 of locking unit 68 is retracted by the operation of locking mechanism 68 by the key (not shown), interlock bar 62 drops down (see FIG. 5) until stop surface 74 of interlock bar 62 rests on the surface of upper plate 15. Stop surface 74 is comprised of a notch as shown in FIGS. 3, 4, and 5, but can also be comprised of a pin or other member protruding from the side of interlock bar 62. When interlock bar 62 drops down until stop surface 74 rests on the top of upper plate 15, slot 72 in interlock bar 62 aligns with the path of flange 58 so that rotation of flange 58 is not limited by mechanical interference with interlock bar 62. Therefore, when locking mechanism 68 is operated to allow interlock bar 62 to drop down, operating handle 40 can be used to rotate operating shaft 22 and to drive circuit interrupter device 56 to the reset position in which the contacts of circuit interrupter device 56 are closed, as is described in greater detail below.

Figure 7A:
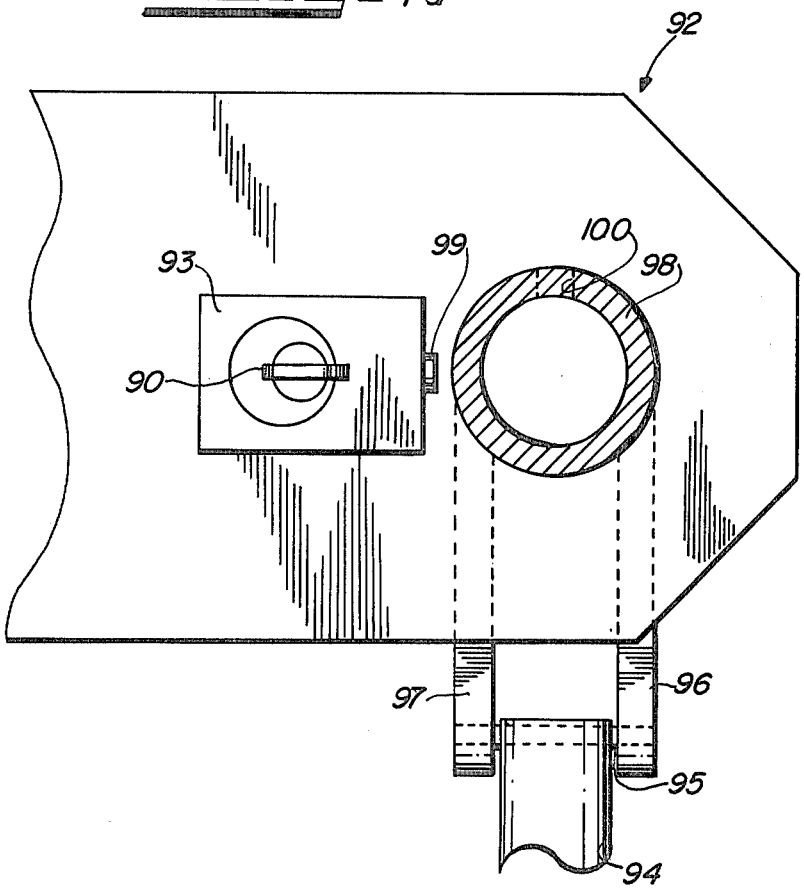
FIG. 7 is a partial view of an operating mechanism for a disconnect switch which may be used with the interrupter switch of FIG. 1 in accordance with the principles of the present invention.
Figure 7B:
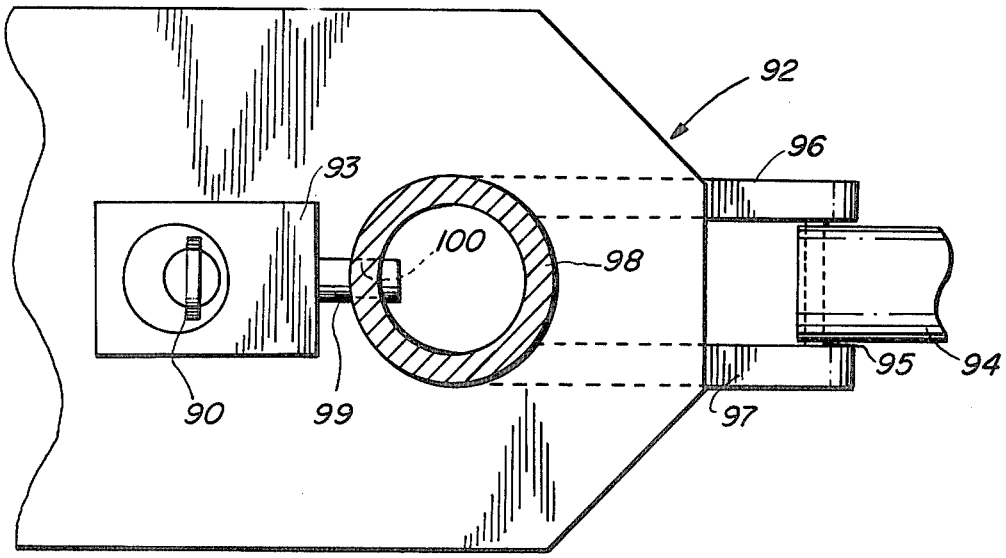

Interlock bolt 64 of locking mechanism 68 is retracted by means of the key 90 to allow interlock bar 62 to drop into a position in which stop surface 74 rests on upper plate 15 and slot 72 aligns with the path of flange member 58. The key 90 can be removed from locking unit 68 only by manually raising interlock bar 62 to a position in which hole 66 in interlock bar 62 is aligned with interlock bolt 64 and turning the key 90 in locking mechanism 68 to cause interlock bolt 64 to be extended through hole 66. Retaining member 75, which may be comprised of a rivet, in interlock bar 62 prevents interlock bar 62 from being lifted completely out of holes 67 and 69 in upper and lower plates 15 and 13. Interlock bar 62 cannot be raised to allow hole 66 to align with interlock bolt 64, and to thereby permit locking mechanism 68 to be operated to "release" the key, unless operating handle 40 is rotated clockwise (as viewed from the top) far enough so that flange 58 is not within slot 72 in interlock bar 62. Operating shaft 22, which is operably connected to interrupter device 56, cannot, because of the nature of the device 56, be rotated clockwise after interrupter device 56 is opened until interrupter device 56 is reset or closed by further rotating operating shaft 22 to its full counterclockwise position. Consequently, the key 90 is trapped in locking mechanism 68 after the interrupter switch has been opened until interrupter device 56 has been reset and operating handle 40 pivoted at least to the trip position, and preferably to the "home" position. An associated disconnect switch 91 is provided. The disconnect switch 91, which is schematically shown in conjunction with the interrupter device 56 in FIG. 8, may include an operating mechanism 92 similar to portions of the handle assembly 10 and partially shown in FIG. 7. The disconnect switch 91 cannot be closed unless the key 90 from locking mechanism 68 is used to operate a second locking mechanism 93 similar to locking mechanism 69 on the operating mechanism 92 of the associated disconnect switch 91. In addition the key 90 required to operate locking mechanism 68 is not available except when the associated disconnect switch 91 is in the open position.

Figure 8A:
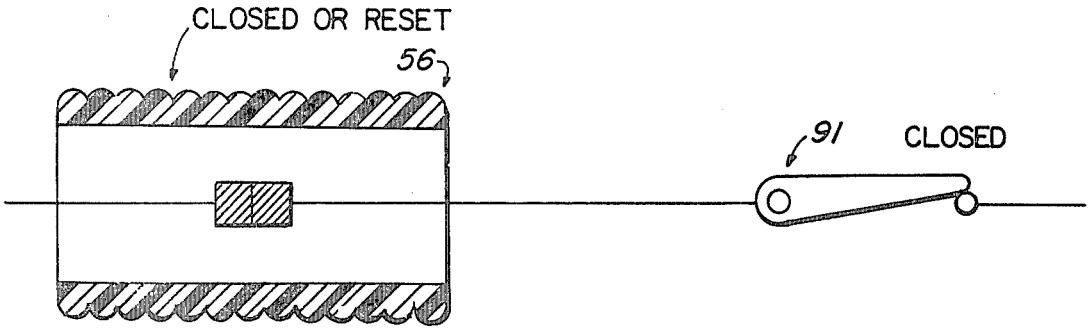
FIG. 8 is a schematic view of the interrupter switch of FIG. 1 and the disconnect switch of FIG. 8 showing the operating sequence thereof effected by the present invention.
Figure 8B:
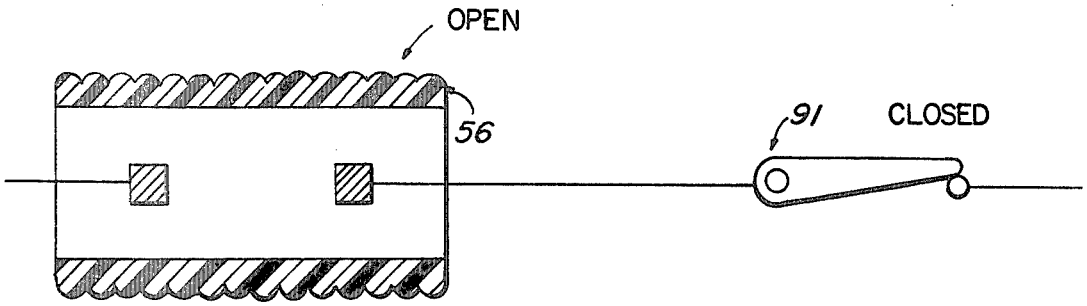
Figure 8C:
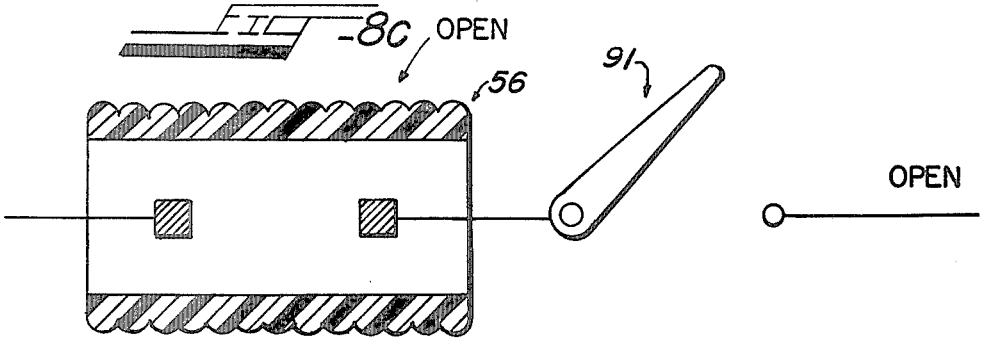
Figure 8D:
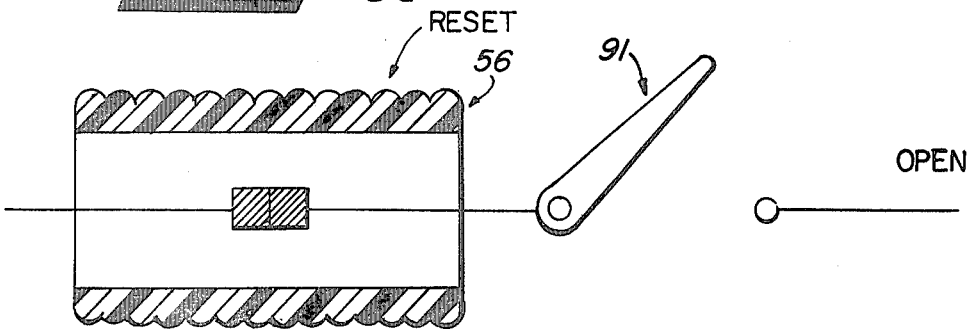

Specifically, the operating mechanism 92 of the switch 91 may include a handle 94 (similar to the handle 40) pivoted on a pin 95 (similar to the pin 42) between two members 96 and 97 (similar to members 25 and 27) which are attached to a rotatable, vertical operating pipe 98 (similar to the shaft 22). Rotation of the handle 94 rotates the pipe 98 to open and close the switch 91, as is well known. When the switch 91 is closed (FIG. 7*a*), a bolt 99 of the second locking mechanism 93 is retracted by the key 90 which, as a consequence, cannot be withdrawn from the mechanism 93. When the handle 94 and the pipe 98 are rotated to open the switch 91, the key 90 may be manipulated to insert the bolt 99 into an aperture 100 formed in the pipe 98. If and only if the bolt 99 is in the aperture—which prevents closing of the switch 91—can the key 90 be removed for manipulation of the locking mechanism 68. Conversely, if the pipe 98 is in any position (such as closed) whereat the bolt 99 cannot enter the aperture 100, the key 90 is trapped in the locking mechanism 93 and cannot be used to unlock the mechanism 68. Thus, the present invention ensures the following sequence:

(a) FIG. 8*a*—With the switch 91 closed and the device 56 reset or closed, current may be conducted through both thereof. Because the switch 91 is closed and the bolt 99 cannot enter the aperture 100 (FIG. 7*a*), the key 90 is trapped in the mechanism 93. Accordingly, the handle assembly 10 may be manipulated only sufficiently to open the device 56 (FIG. 8*b*) and not to reset it;

(b) FIG. 8*b*—With the switch 91 still closed, the device 56 may open due either to manipulation of the handle assembly 10 or to automatic tripping in response to a fault current. Since the switch 91 is closed and the key 90 is trapped in the mechanism 93, the device 56 may not be reset;

(c) FIG. 8*c*—If the switch 91 is now opened and the key 90 operates the mechanism 93 so as to insert the bolt 99 into the aperture 100, the key 90 may be removed and inserted into the mechanism 68. Once the key 90 is removed from the mechanism 93, the switch 91 is locked open and cannot be closed, as described above;

(d) FIG. 8*d*—Operation of the mechanism 68 with the key 90 permits the device 56 to be reset. Until the handle 40 is returned to at least its "home" position, however, the key 90 is trapped in the mechanism 68.

(e) FIG. 8*a*—After the handle is "home," the key 90 may be removed from the mechanism 68 and may be returned to the mechanism 93, manipulation of which permits the switch 91 to again be closed.

Therefore, an interlocking scheme is provided which prevents closing of interrupter device 56 unless the associated disconnect switch 91 is open, which thereby prevents interrupter device 56 operated by manual operating handle assembly 10 from being closed when the circuit is energized. Since the interlocking scheme prevents the closing of interrupter device 56 when the circuit is energized, a less costly interrupter device 56 that need not be capable of withstanding circuit closings can be utilized.

In a variation of the preferred embodiment of the present invention (not shown), a mirror image of the manual operating handle assembly from that illustrated in the accompanying drawings can be provided for installations in which rotation of the operating shaft in a counterclockwise direction is required to operate a high voltage circuit interrupter device. Thus, variations of the present invention permit operation of high voltage circuit interrupters 56 regardless of whether clockwise or counterclockwise rotation of operating shaft 22 is required to trip open and to close such devices.

Another variation of the preferred embodiment of the present invention (not shown) provides only the locking features of manual operating handle assembly 10 without operating handle 40. This variation of the preferred embodiment of the present invention is intended for installations in which it is desirable to rotate operating shaft 22 by means of an operating handle that is separate from manual operating handle assembly 10. Thus, for example, when operating shaft 22 is being used to operate a three-pole interrupter device (not shown), the torque required to rotate operating shaft 22 maybe too great to permit manual rotation of operating shaft 22 directly by pivoting operating handle 40. For such applications a variation of the present invention is provided in which operating shaft 22 extends below manual operating handle assembly 10 and is rotated by means of a gearbox mechanism (not shown). In this variation of the present invention, manual operating handle assembly 10 is identical to the preferred embodiment described above except that operating handle 40 is replaced by a short stub (not shown) having a tab (not shown) similar to tab 44 for preventing rotation when the stub (not shown) is in the "stowed" position. Thus, the locking features as described above for manual operating handle assembly 10 are provided without operating handle 40.

It should be expressly understood that various modifications and changes can be made to the structure of the present invention as illustrated herein without departing from the spirit and scope of the present invention as defined in the appended claims.

I claim:

1. A mechanism for permitting manual operation of an interrupter device to open the interrupter device when a first set of conditions is extant and for inhibiting additional operation of the interrupter device to reset the interrupter device unless a second set of different conditions is extant, which comprises:

mounting means;

an operating shaft suitably supported by said mounting means and operably connected to the interrupter device for opening and resetting the interrupter device;

handle means for manually rotating said operating shaft; and interlock means for, in a first position, limiting the rotation of said operating shaft by said handle means to the amount of rotation required to open the interrupter device, and for, in a second position, not limiting the rotation of said operating shaft so that said operating shaft can be rotated by said handle means to reset the interrupter device.

2. A mechanism for manually operating an interrupter device comprising:

mounting means;

an operating shaft supported by said mounting means and connected to the interrupter device for opening and resetting the interrupter device;

handle means for manually rotating said operating shaft;

interlock means for, in a first position, limiting the rotation of said operating shaft by said handle means to the amount of rotation required to open the interrupter device, and for, in a second position, not limiting the rotation of said operating shaft so that said operating shaft can be rotated by said handle means to reset the interrupter device; and locking means for locking said interlock means in the first position.

3. A mechanism, as claimed in claim 2, wherein said handle means further comprises:

a handle bracket rigidly secured to said operating shaft and having a flange member engaged and interfered with, by said interlock means when said interlock means is in the first position, said handle bracket also having a mounting member;

a handle pivotably mounted to the mounting member of said handle bracket for rotating said handle bracket and said operating shaft, the end of said handle engaging said mounting means thereby holding said handle in a first position except when said handle is rotated to a home position in which the end of said handle does not engage said mounting means thereby permitting said handle to be pivoted to a second position, said handle having a tab for engaging said mounting means when said handle is in the second position thereby preventing rotation of said handle, said handle bracket, and said operating shaft; and a lock bar for engaging said handle and the mounting member of said handle bracket when said handle is in the second position so that said handle cannot be pivoted out of the second position.

4. A mechanism, as claimed in claim 3, wherein said interlock means further comprises:

an interlock bar slidably mounted on said mounting means for engaging and interfering with and thereby limiting the rotation of, the flange member of said handle bracket when said interlock bar is in a first position and said handle bracket and said operating shaft are rotated by said operating handle to trip open the interrupter device, said interlock bar having a configuration such that when said interlock bar is in a second position said interlock bar does not provide interference with the flange member of said handle bracket so that rotation of the flange member is not limited by said interlock bar and said handle bracket and said operating shaft can be rotated by said operating handle to reset the interrupter device.

5. A mechanism for manually operating an interrupter device used in conjunction with a disconnect switch comprising:

mounting means;

an operating shaft suitably supported by said mounting means and operably connected to the interrupter device for opening and resetting the interrupter device;

handle means for manually rotating said operating shaft;

interlock means for, in a first position, limiting the rotation of said operating shaft by said handle means to the amount of rotation required to open the interrupter device, and for, in a second position), not limiting the rotation of said operating shaft so that said operating shaft can be rotated by said handle means to reset the interrupter device; and locking means for locking said interlock means in the first position except when the associated disconnect switch is open.

6. A mechanism, as claimed in claim 5, wherein said locking means comprises:

a key which is available only when the disconnect switch is locked in the open position; and a locking mechanism rigidly mounted on said mounting means, said locking mechanism having an interlock bolt which is extendable for locking said interlock means when said locking mechanism is in the locked position and which is retractable to unlock said interlock means when said locking mechanism is unlocked by operation of said key, said locking mechanism being operable by inserting said key thereinto and rotating said key to retract the interlock bolt into said locking mechanism, said locking mechanism trapping said key within said locking mechanism except when said key is rotated to extend the interlock bolt in the locked position.

7. A mechanism for manually operating an interrupter device, which comprises:

mounting means;

an operating shaft suitably supported by said mounting means and operably connected to the interrupter device for opening and resetting the interrupter device;

interlock means for, in a first position, limiting the rotation of said operating shaft to the amount of rotation required to open the interrupter device, and for, in a second position, not limiting the rotation of said operating shaft so that said operating shaft can be rotated to reset the interrupter device;

a bracket rigidly secured to said operating shaft and having a flange member engaged, and interfered with, by said interlock means when said interlock means is in the first position, said bracket also having a mounting member;

a stub member pivotably mounted to the mounting member of said bracket, the end of said stub member engaging said mounting means and thereby holding said stub member in a first position except when said stub member is rotated to a home position in which the end of said stub member does not engage said mounting means thereby permitting said stub member to be pivoted to a second position, said stub member having a tab for engaging said mounting means when said stub member is in the second position thereby preventing rotation of said stub member, said bracket and said operating shaft; and a lock bar for engaging said stub member and the mounting member of said bracket when said stub member is in the second position so that said stub member cannot be pivoted out of the second position.

8. An improved mechanism for manually operating an interrupter device comprising:

a base;

a mounting bracket suitably mounted to said base and having a first plate containing first and second holes and a slot and a second plate containing a first hole aligned with the first hole in the first plate and a second hole concentric with the second hole in the first plate and a slot aligned with the slot in the first plate;

an operating shaft operably connected to the interrupter device for causing the interrupter device to trip open and to reset and rotatably supported in the concentric holes in the first and second plates of said mounting bracket;

a handle bracket rigidly secured to said operating shaft between the first and second plates of said mounting bracket and having a flange member and first and second mounting members;

an operating handle pivotably mounted to said handle bracket between first and second mounting members so that said operating handle can be pivoted to a stowed position when said operating handle is rotated to the position in which the end of said operating handle is aligned with the slot in the first plate of said mounting bracket, said operating handle having a tab for engaging the slot in the second plate of said mounting bracket and thereby preventing rotation of the operating handle, said handle bracket, and said operating shaft when said operating handle is pivoted to the stowed position;

an interlock bar slidably mounted in the first hole in the first plate and the first hole in the second plate of said mounting bracket for engaging and thereby limiting the rotation of the flange member of said handle bracket when said handle bracket and said operating shaft are rotated by said operating handle to trip open the interrupter device and said interlock bar is in a first position, said interlock bar having a stop member and a configuration such that when said interlock bar is in a second position with the stop member resting on the first plate of said mounting bracket said interlock bar does not interfere with the flange member of said handle bracket so that rotation of the flange member is not limited by said interlock bar and said handle bracket and said operating shaft can be rotated by said operating handle to reset the interrupter device, said interlock bar also having a hole; and locking means having an interlock bolt which can be extended to engage the hole in said interlock bar thereby holding said interlock bar in the first position and which can be retracted to disengage the hole in said interlock bar thereby permitting said interlock bar to be moved to the second position.

9. A mechanism for controlling the sequence of operation of both a normally set circuit interrupting device and an apparatus for operating the device, the operating apparatus having a normal first location; the interrupting device being of the type which is (a) tripped by movement of the operating apparatus from the first location to a second location, and (b) reset by movement of the operating apparatus in the same direction from the second location to a third location, following which latter movement the operating apparatus may be moved back to the first location in a reverse direction; the mechanism comprising:

first two-position locking means for preventing, in the first position thereof, movement of the operating apparatus from its first to its second location and for permitting, in the second position thereof, movement of the operating apparatus between its first and second locations;

second two-position locking means for preventing, in the first position thereof, movement of the operating apparatus from its second to its third location and for permitting, in the second position thereof, movement of the operating apparatus between its second and third locations;

first means for preventing the first locking means from assuming its first position unless the operating apparatus is in its first location, and second means for preventing the second locking means from assuming its first position unless the operating apparatus is in its second or first location.

10. The mechanism of claim 9, wherein following movement of the first locking means to its second position, the operating apparatus is movable from its first to its second location to trip the device and may thereafter remain in either its second location or be returned to its first location, following movement of the second locking means to its second position, the operating apparatus is movable from its second to its third location to reset the device and may thereafter either remain in its third location or be returned to its second or first location.

11. The mechanism of claim 10, wherein the device is in electrical series with a disconnect switch, which further comprises means for permitting movement of the second locking means to its second position only after and when the switch is opened, and permitting closing of the switch only after and when the operating apparatus is in its second or first location and the second locking means is in its first position, whereby the device may not be tripped unless the switch is open and the switch may not be closed unless the device is set or reset.

12. The mechanism of claim 11, wherein the operating apparatus includes a shaft journalled for rotation in a first plate, and wherein the first locking means comprises a handle mounted on the shaft for pivoting from a position generally parallel to the shaft to a position generally normal to the shaft, rotation of the handle in its shaft-normal position rotating the shaft;

a protruding tab on the handle; and a first slot in the first plate for receiving the tab when the handle is parallel to the shaft so that rotation of the handle is prevented and for not receiving the tab when the handle is normal to the shaft so that the handle may be rotated.

13. The mechanism of claim 12, wherein the first preventing means comprises a second plate parallel to the first plate and spaced therefrom, and a second slot in the second plate and generally aligned with the first slot for permitting an end of the handle to occupy the space between the plates when the handle is normal to the shaft, the second plate preventing pivoting of the handle from the shaft-normal to the shaft-parallel position after the handle has been rotated away from the slots.

14. The mechanism of claim 11, wherein the operating apparatus includes a shaft journalled for rotation in a first plate, and wherein the second locking means comprises a flange perpendicularly protruding from the shaft for rotation therewith; and a two-position bar slidable in the first plate between one position in which the bar interferes with the flange and another position in which the bar does not interfere with the flange.

15. The mechanism of claim 14, wherein the second preventing means comprises the flange having an arcuate extent in its plane of rotation, and a slot in the bar which in the other position of the bar permits the flange to be positioned therein, the bar being unable to assume its one position until the flange is removed from the slot.

* * * * *